US006945918B1

(12) United States Patent
Hill

(10) Patent No.: US 6,945,918 B1
(45) Date of Patent: Sep. 20, 2005

(54) EXERCISE BAR

(76) Inventor: Rob Hill, 10621 Commadore, Anchorage, AK (US) 99508

( * ) Notice: Subject to any disclaimer, the term of this patent is extended or adjusted under 35 U.S.C. 154(b) by 304 days.

(21) Appl. No.: 10/431,115

(22) Filed: May 6, 2003

(51) Int. Cl.[7] ..... A63B 21/072
(52) U.S. Cl. ..... 482/106; 482/104; 482/91
(58) Field of Search ..... 482/104–107, 482/108, 91, 148, 126, 122, 49, 50, 139

(56) References Cited

U.S. PATENT DOCUMENTS 3,588,102 A * 6/1971 Gifford ..... 482/106
4,345,756 A * 8/1982 Hoagland ..... 482/109
4,807,873 A * 2/1989 Naquin ..... 482/105
4,900,015 A * 2/1990 Dissinger ..... 482/141
5,836,858 A * 11/1998 Sharff ..... 482/106
5,868,651 A * 2/1999 Washington ..... 482/91
6,010,439 A * 1/2000 Bullard, Jr. ..... 482/106

* cited by examiner

*Primary Examiner*—Jerome W. Donnelly
(74) *Attorney, Agent, or Firm*—Michael J. Tavella

(57) ABSTRACT

An exercise bar, shaped like a motocross handlebar, that be attached to any multifunction gym. The user grips the bar as he/she would grip a regular motocross handlebar when working out, which works those muscles in the hands and arms that normally are used in motocross riding. A support bar is added to the top portion of the bar for added stiffness and to provide support for a retractable shaft for pulling exercises. A telescoping hook is also provided at the bottom to support a dumbbell that can be suspended at the bottom of the bar. The extended arm portions of the bar are fitted with locking hinges that allow the bar arms to fold for storage or for travel. A kit is also disclosed that allows the conversion of a standard handlebar into an exercise bar.

10 Claims, 4 Drawing Sheets

EXERCISE BAR

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to exercise bars and particularly to exercise bars used to train for motocross riding.

2. Description of the Prior Art

The sport of motocross cycling (either on motorcycles or bicycles) has been enjoyed for years by thousands of people. Motocross, however, is an athletic event that requires proper conditioning. At the competitive levels, the sport requires excellent physical conditioning to be able to participate with any kind of competence. One area of conditioning that is required is that of the hands and arms. Since motocross bikes are steered using handlebars, hand and arm strength and flexibility are essential.

There are exercises that can develop the hands and arms. These exercises can be done on exercise equipment such as a multi-function gym machine, which has weight bars that can be attached to cables that can be weighted down further. Weights are attached to the machine and the bars are gripped by the user to pull the weights in a particular direction and with a particular arm spacing. In this way, different muscle groups can be worked.

Several such exercise machines and handles have been patented over the years. Examples are found in the following U.S. Pat. Nos. 4,691,916, 4,792,135, 5,352,171, and 5,947,873 and in the following published U.S. Patent Application: U.S. 2002/0028733. In addition, U.S. Pat. Nos. 5,273,509 and 4,743,018 teach specific handles for use with exercise machines. Finally, U.S. Pat. No. 5,533,899 teaches a motorcycle trainer. This is a device designed to exercise the entire body to handle the riggers of rough ridings, such as motocross. This device is a machine that has a frame and several springs and plates that are covered by a body similar to that of a motorcycle without the wheels. The plates and springs are either controlled hydraulically or electrically to move a rider up and down and side to side. The idea is to work the muscles in the same manner as they would be worked while actually riding.

While all of these devices are suitable for what they are intended for, all of them except for the last patent do not specifically work muscles used n motocross. The latter machine does this, but requires a specialized machine that is expensive and complex.

BRIEF DESCRIPTION OF THE INVENTION

The instant invention overcomes all of these problems. It is an exercise bar that be attached to any multifunction gym. The device needs no electricity or hydraulics to use. The bar is shaped like a motocross handlebar. In this way, the user grips the bar as he/she would grip a regular motocross handlebar. Thus, when working out, the user works those muscles in the hands and arms that normally are used in motocross riding. The invention has two ends that are formed to simulate a true handlebar. Grips are attached to ensure the grip matches that if a true handlebar. A support bar is added to the top portion of the bar for added stiffness and to provide support for a retractable shaft for pulling exercises. A telescoping hook is also provided at the bottom to support a dumbbell that can be suspended at the bottom of the bar. The top support bar also has an opening to allow a clip from an exercise machine cable to be attached. In this way, the bar can be attached to the machine and the user can use the bar in various exercises with the machine. The advantage, of course, is that with the invention, the user gets the maximum benefit from the workout for motocross riding.

The extended arm portions of the bar are fitted with locking hinges. These allow the bar arms to fold into the center to reduce the size of the bar for storage or for travel.

In a second embodiment, a simpler design is also shown. This design has a smaller profile and is more compact vertically. It too can be folded for storage.

Finally, a kit is also disclosed that allows a user to convert any handlebar into an exercise bar.

DETAILED DESCRIPTION OF THE INVENTION

Figure 1:
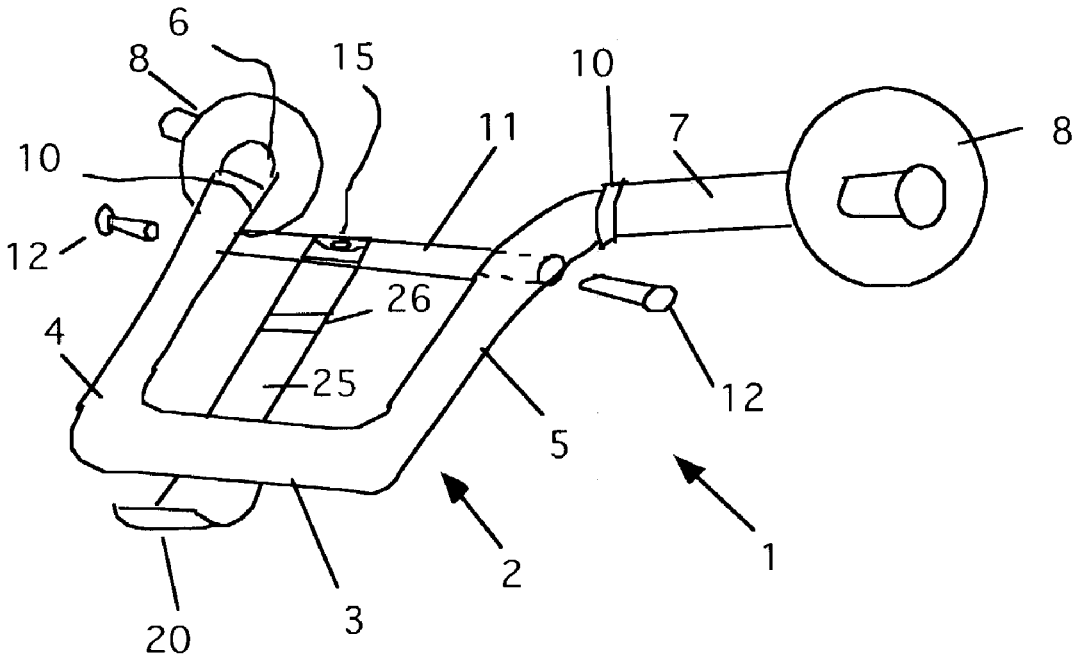
FIG. 1 is a perspective view of the first embodiment of the invention.

Referring now to FIG. 1, a perspective view of the first embodiment of the invention is shown. The invention 1 has a main bar 2 that is shaped like a motocross handlebar, i.e., it has a center portion 3, two side angled portions 4 and 5 that extend upward from the center portion and two horizontal grip members 6 and 7 that extend out sideways from the two side angled portions. The two horizontal grip members 6 and 7 are fitted with rubber handgrips 8 to further simulate the feel of an actual handlebar.

Unlike an actual handlebar, the invention 1 has two locking hinges 10 placed at the junction of the horizontal members and angled portions. The locking hinges allow the exercise bar 1 to be folded up for storage or travel. The invention also has a center bar 11. This bar is attached with pins or other fasteners 12 in an ordinary manner. The bar is used to support a fitting 15 that is used to attach the bar 1 to the cable or an exercise apparatus. The center bar also has an extendable hook portion 20. The hook portion 20 can be pulled down, if desired to support a dumbbell from the hook, thereby adding a specific amount of weight.

Figure 2:
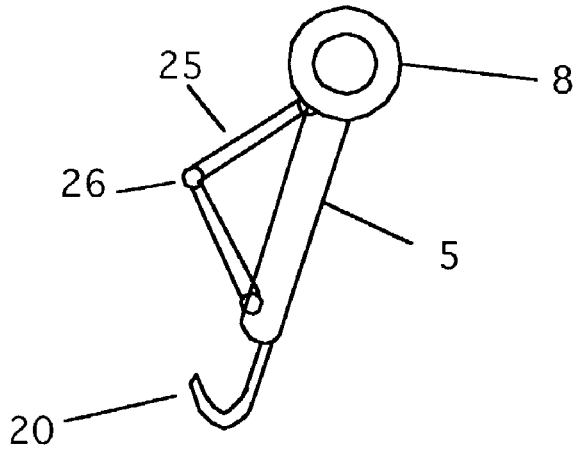
FIG. 2 is a side view of the invention.

A retractable shaft 25 is attached to the device as shown in FIGS. 1 and 2. This shaft is normally maintained in a flat configuration. However, if the user desires to use the bar for pulling, the shaft 25 can be extended out (see FIG. 2.) for use. A bar 26 allows a cable to be attached for pulling exercises. The retractable shaft 25 is hinged so that it can be pulled out and folded flat, as desired. The flat configuration makes the device easier to store.

Figure 3:
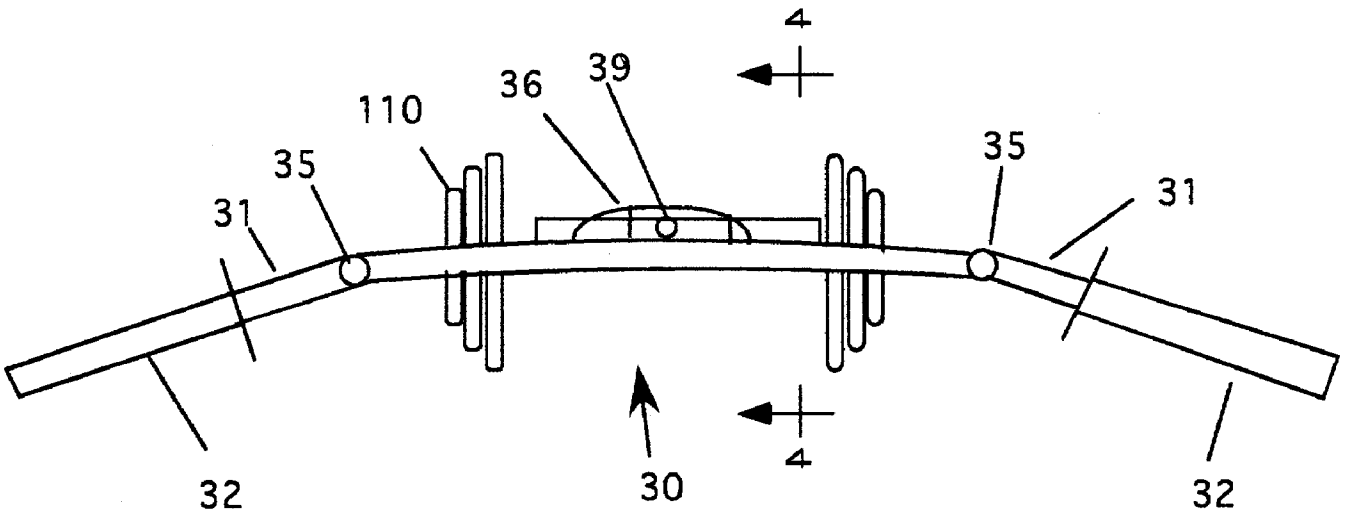
FIG. 3 is a top view of the second embodiment of the invention.
Figure 4:
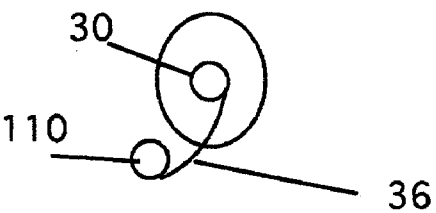
FIG. 4 is a cross-sectional view of the second embodiment taken along the lines 4—4 of FIG. 3.

FIGS. 3 and 4 show an alternative embodiment. FIG. 3 is a top view. This embodiment has a flat bar 30 that has two swept-back handles 31. As before, these handles can be covered with rubber grips 32. Hinges 35 are positioned as shown, to allow the unit to be folded for storage or transport. A clip 39 is also provided to attach a cable from an exercise machine.

A small hook 36 extends down and outward from the center of the bar. See FIG. 4. This hook is used to suspend a dumbbell 110 as shown. FIG. 4 is a sectional view showing the shaft of the dumbbell in the hook.

Figure 5:
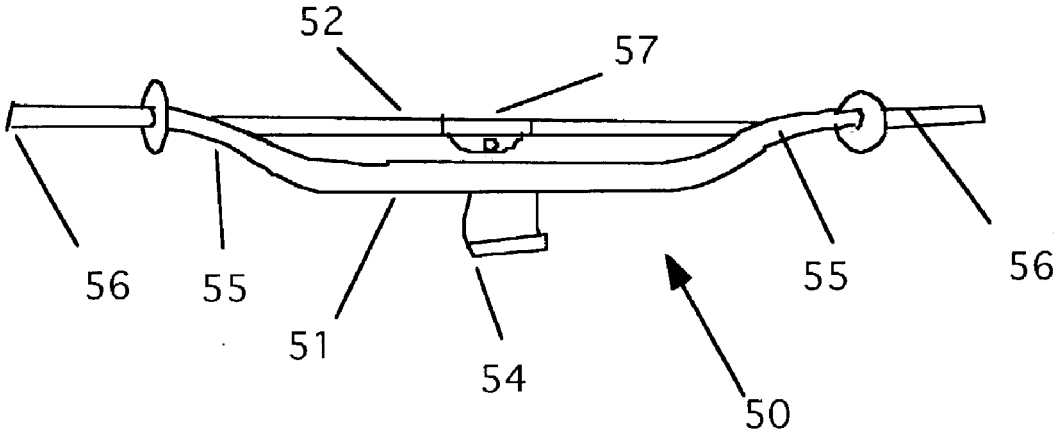
FIG. 5 is a front view of a third embodiment of the invention.

FIG. 5 is a third embodiment. In this embodiment, the bar 50 is similar to that of the embodiment of FIG. 1, except that the space between the center bar 52 and the lower center member 51 is shorter. This device has a retractable dumbbell hook 54, a bracket 57 to attach a cable, two angled arms 55 and two rubber handgrips 56 as before.

Figure 6:
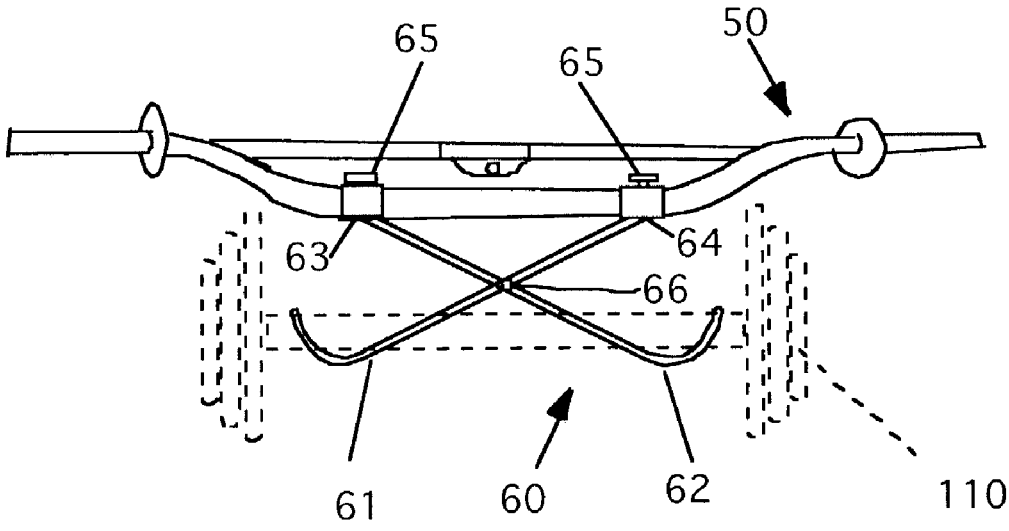
FIG. 6 is a front view of the third embodiment showing an alternate dumbbell hanger, suitable for use with all embodiments.

FIG. 6 is a modification of the embodiment of FIG. 5. Here, the dumbbell hook 54 is replaced by a cross brace system 60. This system has two hook-shaped braces 61 and 62, which are secured to the lower center member 51 by clamps 63 and 64. The clamps are secured to the lower center member by two thumbscrews 65. A pivot member 66 allows the hook-shaped braces 61 and 62 to be folded for storage. When opened, a dumbbell 110 can be placed on the hooks, as shown. The two hook-shaped braces 61 and 62 provide a wider support base for the dumbbell, thereby adding an additional degree of safety. Note that the hook-shaped braces 61 and 62 of FIG. 6 can be used with any of the embodiments shown. The extendable dumbbell support of the other embodiments is simply replaced with the hook-shaped braces 61 and 62 of FIG. 6, to be used in an identical manner.

Figure 7:
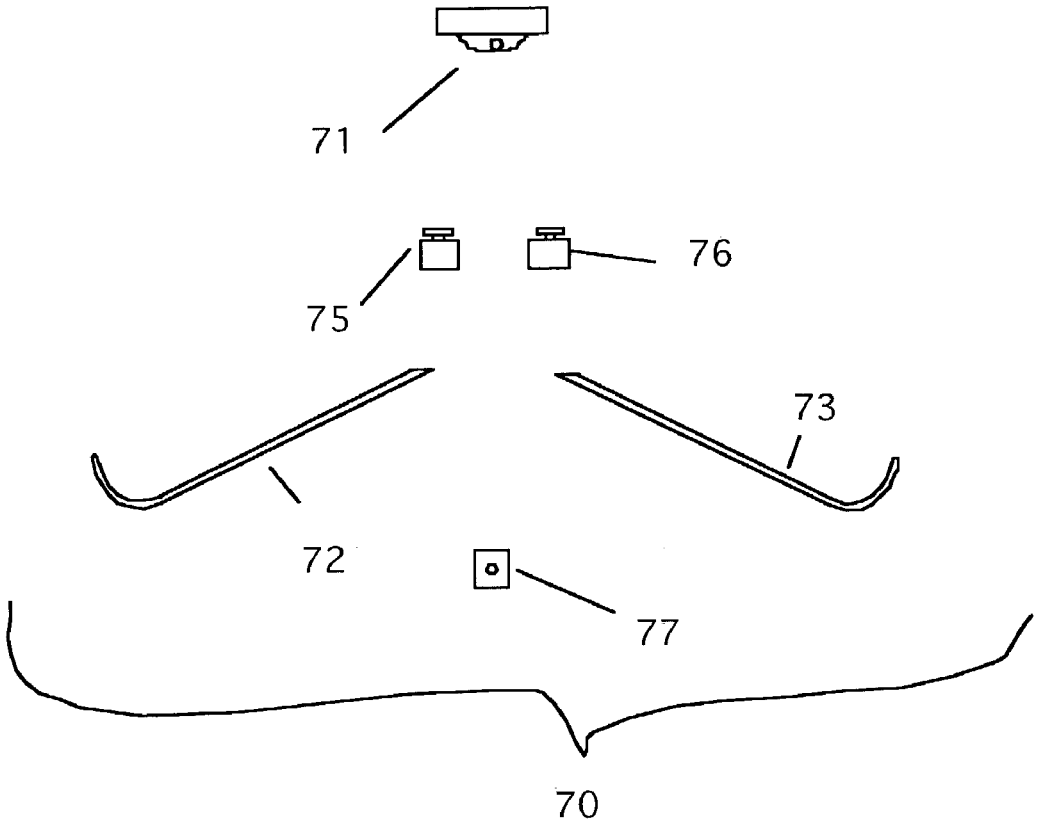
FIG. 7 is a detail of a conversion kit for modifying an existing handlebar for use as an exercise bar.
Figure 8:
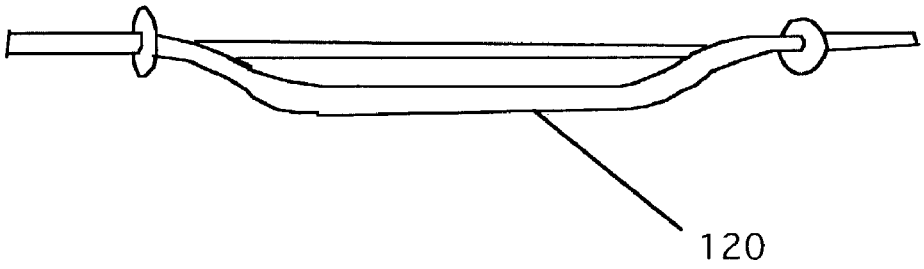
FIG. 8 is a front view of a plain handlebar that can be converted to an exercise bar using the conversion kit of claim 7.

FIG. 7 shows a kit that can be used to modify any standard motocross (or other handlebar) for use as an exercise bar. Frequently, motocross riders replace the stock handlebars found on a bike with custom designs better suited to the rider. The old handlebars are typically discarded. FIG. 8 shows a typical plain handlebar 120 that is suitable for conversion. Using the kit, however, they can be recycled for use in a gym. The kit 70 has a number of elements. The first is a bracket 71 that clamps onto the handlebar. This bracket is used to attach a cable to the handlebar. The second and third are hook-shaped braces 72 and 73. These braces are identical to those of the embodiment of FIG. 6. There are also two clamps with thumbscrews 75 and 76 that are used to attach the hook-shaped braces 72 and 73 to the handlebar. Finally, a pivot clamp 77 attaches to crossover point of the hook-shaped braces 72 and 73 to tie the two braces together for use and to allow them to pivot back for storage.

Installing the kit is easy. First, the bracket 71 is secured to the handlebar using ordinary fasteners. Then the hook-shaped braces 72 and 73 are secured using the clamps with thumbscrews 75 and 76. These are adjusted as needed until the hook-shaped braces 72 and 73 are in their proper position. Finally, the pivot clamp 77 is adjusted as needed to ensure the hook-shaped braces 72 and 73 can be positioned as desired. The pivot clamp 77 can be attached to the hook-shaped braces 72 and 73 when the kit is packaged or it can be attached when the kit is assembled. When complete, the assembled exercise bar is ready to use, as shown in FIG. 7.

As mentioned above, the kit can be attached to any handlebar. Because the hook-shaped braces allow weights to be suspended from the bar, any handlebar can be made suitable for use as an exercise bar.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. An exercise bar for developing muscles used in motocross cycle riding comprising:

a) a main bar having a center portion, two side angled portions attached to said center portion and extending upward from said center portion, and two horizontal grip members, hingably attached to said side angles portions and extending out sideways therefrom;

b) a pair of locking hinges, attached to said two side angled portions and said two horizontal grip members;

c) a center support bar, attached to said two side angles portions and being positioned between said two angled portions, and further said center support bar lying generally parallel to said center portion of said main bar; and d) a means for supporting a dumbbell, operatively attached to said center portion of said main bar.

2. The exercise bar of claim 1, further comprising two rubber handgrips, installed on the two horizontal grip members.

3. The exercise bar of claim 1 wherein the means for supporting a dumbbell comprises an extendable hook portion, operatively attached to said center portion of said main bar.

4. The exercise bar of claim 1 wherein the means for supporting a dumbbell comprises a pair of hook-shaped braces, pivotably attached to said center portion of said main bar, such that said pair of hook-shaped braces extend below said center portion of said main bar, and further wherein said pair of hook-shaped braces form an "X" configuration.

5. The exercise bar of claim 1, further comprising a retractable shaft, pivotably attached to said two side angles portions, said retractable shaft having a first position, where said retractable shaft lies in the same general plane as the exercise bar, and a second position whereby said retractable shaft is pivoted outward from said exercise bar such that it forms a V shaped structure lying in a place forward of said exercise bar.

6. The exercise bar of claim 5 wherein the retractable shaft has a center and further wherein a means for attaching a cable is installed in the center of said retractable shaft.

7. An exercise bar for developing muscles used in motocross cycle riding comprising:

a) a flat bar having a center section and two angled handle ends, extending outward and rearward from said center section, whereby said center section and said two angled handle ends all lying in the same horizontal plane;

b) a means for supporting a dumbbell, operatively attached to said flat bar;

c) a means for securing said exercise bar to a cable; and d) a pair of hinges, operable installed between said center section and said two angled handle ends, whereby said hinges permit said exercise bar to form a first position, whereby said two angled handle ends are extended outward from said center portion and a second position whereby the two angled handle ends are folded inward toward said center portion.

8. The exercise bar of claim 7 wherein the two angled handle ends are covered with rubber grips.

9. The exercise bar of claim 7 wherein the means for supporting a dumbbell comprises an extendable hook shelf, extending downwardly and outwardly from said center section.

10. The exercise bar of claim 7 wherein the means for supporting a dumbbell comprises a pair of hook-shaped braces, pivotably attached to said center portion of said main bar, such that said pair of hook-shaped braces extend below said center portion of said main bar, and further wherein said pair of hook-shaped braces form an "X" configuration.

* * * * *